US006557732B2

(12) United States Patent
Van Rompuy et al.

(10) Patent No.: US 6,557,732 B2
(45) Date of Patent: May 6, 2003

(54) DETERGENT PACK

(75) Inventors: Tanya Cecile Corneel Van Rompuy, Hofstade-Zemst (BE); Brian Xiaoqing Song, West Chester, OH (US); Elizabeth Ann Alam, West Chester, OH (US); Frank William DeNome, Cincinnati, OH (US); Helen Varley, Newcastle upon Tyne (GB); Kenton Ray Lynde, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/906,479

(22) Filed: Jul. 16, 2001

(65) Prior Publication Data

US 2002/0084285 A1 Jul. 4, 2002

(30) Foreign Application Priority Data

Jul. 19, 2000 (WO) ..... PCT/US00/19619
Jul. 25, 2000 (WO) ..... PCT/US00/20255
Dec. 21, 2000 (WO) ..... PCT/US00/34910

(51) Int. Cl.[7] ..... A47L 15/44

(52) U.S. Cl. ..... 222/136; 222/1; 222/145.1; 222/145.4; 222/145.7; 134/95.1; 134/99.1; 68/17 R

(58) Field of Search ..... 222/134–137, 222/1, 145.1, 145.4, 145.7, 145.8; 134/95.1, 99.1, 99.2, 100.1; 68/17 R

(56) References Cited

U.S. PATENT DOCUMENTS 4,218,264 A * 8/1980 Federighi et al. ..... 134/103.1
4,678,103 A 7/1987 Dirksing
4,730,381 A 3/1988 Dirksing
4,784,168 A * 11/1988 Erminio ..... 134/100.1
4,964,185 A * 10/1990 Lehn ..... 134/93
5,068,937 A * 12/1991 Meloni et al. ..... 68/17 R
5,102,573 A 4/1992 Han et al.
5,592,966 A * 1/1997 Gates ..... 137/513.5
5,870,906 A * 2/1999 Denisar ..... 134/936
5,900,395 A * 5/1999 Nicholson et al. ..... 510/224
5,929,007 A 7/1999 Feng
6,055,831 A * 5/2000 Barbe ..... 137/557

FOREIGN PATENT DOCUMENTS

| | | |
|---|---|---|
| JP | A-10017900 | 1/1998 |
| JP | A-11117000 | 4/1999 |
| WO | WO 94/28108 | 12/1994 |
| WO | WO 00/61712 | 10/2000 |
| WO | WO 00/61713 | 10/2000 |
| WO | WO 02/08370 A2 | 1/2002 |
| WO | WO 02/08371 A2 | 1/2002 |
| WO | WO 02/08509 A1 | 1/2002 |

* cited by examiner

*Primary Examiner*—J. Casimer Jacyna
(74) *Attorney, Agent, or Firm*—Kevin L. Waugh

(57) ABSTRACT

A detergent pack for use in conjunction with a washing machine and which comprises two or more detergent or auxiliary products, storage means comprising separate but associated portions of the two or more products, and means for delivering quantities of the two or more products into the same or different cycles of a washing machine, said means for delivering comprising means for dispensing quantities of the two or more products, and means for controlling the relative dispensing rate of the two or more products from the storage means.

40 Claims, 2 Drawing Sheets

DETERGENT PACK

TECHNICAL FIELD

The present invention is in the field of detergents, in particular it relates to detergent packs for use in conjunction with a washing machine and which includes two or more detergent or auxiliary products with different functionalities. The detergent packs are especially useful in dishwashing for the removal of cooked-, baked- and burnt-on soils from cookware and tableware.

BACKGROUND OF THE INVENTION

Dishwashing loads are usually characterised by including articles made of different materials (i.e. stainless steel, glass, plastic, wood, ceramic, china, porcelain, etc) and soiled with different food residues (i.e. proteinaceous, carbohydrates, grease, starch, carotenoids, etc). The removal of all the soils from the dishwashing load usually requires a combination of several detergent ingredients. However, in many cases not all the ingredients are compatible with one another and it can be a difficult or impossible task to combine and stabilise them into a single composition.

Cooked-, baked- and burnt-on soils are amongst the most severe types of soils to remove from surfaces. Traditionally, the removal of cooked-, baked- and burnt-on soils from cookware and tableware requires soaking the soiled object prior to a mechanical action. Apparently, the automatic dishwashing process alone does not provide a satisfactory removal of cooked-, baked- and burnt-on soils. Manual dishwashing processes may require a tremendous rubbing effort to remove cooked-, baked- and burnt-on soils and this can be detrimental to the safety and condition of the cookware/tableware.

The use of cleaning compositions containing solvent for helping in the removal of cooked-, baked- and burnt-on solids is known in the art. For example, U.S. Pat. No. 5,102,573 provides a method for treating hard surfaces soiled with cooked-on, baked-on or dried-on food residues comprising applying a pre-spotting composition to the soiled article. The composition applied comprises surfactant, builder, amine and solvent. U.S. Pat. No. 5,929,007 provides an aqueous hard surface cleaning composition for removing hardened dried or baked-on grease soil deposits. The composition comprises nonionic surfactant, chelating agent, caustic, a glycol ether solvent system, organic amine and anti-redeposition agents. WO-A-94/28108 discloses an aqueous cleaner concentrate composition, that can be diluted to form a more viscous use solution comprising an effective thickening amount of a rod micelle thickener composition, lower alkyl glycol ether solvent and hardness sequestering agent. The application also describes a method of cleaning a food preparation unit having at least one substantially vertical surface having a baked food soil coating. In practice, however, none of the art has been found to be very effective in removing baked-on, polymerized soil from metal and other substrates.

The use of solvents in the automatic dishwashing context is also known. JP-A-10,017,900 discloses an automatic dishwashing auxiliary composition comprising non-ionic low foaming surfactant, organic solvent and water. The composition delivers detergency and drying benefits. JP-A-11,117,000 discloses a cleaning assistant composition for automatic dishwashing machines comprising surfactant, organic high-molecular polyelectrolyte, water-soluble solvent and water. The claimed assistant composition helps in the cleaning of stubborn dirt such as that due to oil or lipstick.

Multi-compartment dispensing devices are used for the storage of chemical systems which require two or more components to be kept separate before their use. There are many examples of such devices in the art, for example U.S. Pat. Nos. 4,678,103 and 4,730,381 disclose plural-chambered, gravity-activated dispensing devices for two or more flowable products at a substantially constant, predetermined ratio; WO-A-00/61712 and WO-A-00/61713 disclose liquid cleaning compositions comprising bleach and bleach activators which are held separate from each other in a single container. These multi-compartment dispensing devices can deliver a predetermined ratio of the multiple compositions however the total amount delivered needs to be measured by the consumer. Moreover maintaining a constant ratio can be difficult in the case of gel-form compositions or products delivered at a high ratio relative to one another.

There is a need for a detergent pack capable of delivering all the chemistry necessary, in a physically stable form, to clean any washing or dishwashing load, even those loads having extremely problematic soils such as cooked-, baked- and burnt-on soils. The pack should provide maximum convenience and minimum effort for the user by automatically delivering a predetermined dose of detergent.

SUMMARY OF THE INVENTION

According to a first aspect of the present invention, there is provided a detergent pack for use in conjunction with a washing machine and which comprises two or more detergent or auxiliary products, storage means comprising separate but associated portions of the two or more products, and means for delivering quantities of the two or more products into the same or different cycles of a washing machine. Preferably the means for delivering quantities of the two or more products comprises means for dispensing quantities of the two or more products, and means for controlling the relative dispensing rate of the two or more products from the storage means.

The pack can, for example, be a multi-compartment bottle-shaped storage container containing different products in the different compartments, the products being simultaneously delivered at a predetermined ratio into the washing machine. The pack can be hand-held whereby the two or more products are manually dosed into the washing machine dispenser as required by the user. Alternatively, the pack can be built-into or accommodated as a replaceable unit in a washing machine, whereby the two or more products are automatically delivered into the washing machine under program control in accordance with the requirements of the user on the wash process parameters. The packs of the invention allow the inclusion of products incompatible with one another into the same storage means and the delivery of the different products in a fixed relative ratio. The packs of the invention simplify the process of delivering different and incompatible compositions into the washing machine.

In a preferred embodiment the pack comprises at least two product containers for separate storage of the two or more detergent or auxiliary products. By auxiliary product is understood to be a product which is capable of improving the result of the washing process over that achieved when using the detergent product alone. Suitable product containers include for example rigid or semi-rigid bottles made of plastics material. Although there is no theoretical limitation as to the size and shape of the product containers, the containers will normally have, for practical reasons, capacities of from about 0.11 to about 5 1 preferably from about 0.21 to about 1.51 by volume. The storage means can include means for refilling thereof, such as for example reclosable opening in each of the product containers or the storage means can be removed or replaced as a unit for the purpose of recharging the pack with fresh product. The pack is normally constructed to include an outer shell which provides at least part of the external framework of the pack, the storage means being adapted to fit wholly or partly within the outer shell. In a preferred embodiment the outer shell and the storage means together form the exterior framework of the pack, this facilitating the refilling and replacement of the storage means when required by the user.

In preferred embodiments the storage means comprises two or more product containers mounted in an inverted orientation with corresponding outlets directed in a generally downward direction to provide gravitational-assisted dispensing therefrom. Inverted orientation is particularly suitable in cases in which the two or more detergent or auxiliary products have very high viscosity. The downward direction of dispensing avoids the need of tilting the pack to pour out the two or more detergent or auxiliary products. Moreover, the volume of the two or more product containers will generally be in integer ratio to one another (±5% or so). This allows refilling or replacement of the various product containers at the same time.

The means for dispensing generally comprises one or more conduit means, connecting with one or more dispensing orifices and having one or more valves associated therewith to enable or cut off the flow of product through the one or more dispensing orifices. In preferred embodiments the conduit means take the form of one or of a plurality of flexible tubes, for example silicone rubber tubes. The tubes can have the same or different diameters. The diameter of each tube is chosen as function of the required delivery rate of the products associated therewith. Particularly suitable valves for use at or proximal to the inlet of the each conduit means are duckbill valves which allow to regulate the flow as well as venting of the sealed containers. In a preferred embodiment, separate conduit means are provided for each of the two or more products and these conduit means lead to and communicate to the outlet with a common valve means, for example a slit seal valve having a dispensing orifice in the form of slit which is normally closed but which can be opened under pressure to allow dispensing of the product. This valve helps to deliver the products in a clean manner avoiding any dripping after delivery.

The relative dispensing rate of the two or more products can be controlled by one or more electrically operated pumps adapted to dispense the two or more products at given flow rates, or for given dispensing times or in a given product dispensing sequence. Preferably the relative dispensing rate is controlled by a positive displacement pump. This kind of pump is particularly suitable herein for providing controlled dosages of multiple products. A preferred pump for use herein is a peristaltic pump which is operatively associated with the flexible tubes described hereinabove to provide a fixed relative dispensing rate. The peristaltic pump can also include means such as a retropumping system for pumping the two or more products in a reverse direction at the end of the dispensing cycle in order to prevent excess product dripping from the dispensing orifices. The relative dispensing rate is determined by the relative diameter of the flexible tubes and by the rheology of the two or more detergent or auxiliary products. In a preferred embodiment the products are in gel form, the rheology or the gel-form compositions, being matched to provide dispensing of the two or more products at a controlled relative dispensing rate. Products are considered to be rheology-matched if they have similar yield values (differing by less than about 50%, preferably by less than about 20%) and/or similar viscosities (differing by less than about 50%, preferably by less than about 20%) under the same shear conditions.

Another feature of the packs of the invention is an automatic cut-off switch operable when the pack is resting on a surface. The pack also includes means for preselecting the dosages or quantities of the two or more product to be dispersed. The pack allow for dosing an optimum amount effective for high, medium or lightly soiled loads. Additionally, the pack can also include means overriding the preselecting means to provide continuous dispensing, thereby allowing the consumer to add an extra amount of product. The pack also preferably comprises a visual indication of dispensing such as a movable spout situated in the vicinity of the dispensing orifices and which indicates when the dispensing system is in operation.

The packs of the invention can be used in conjunction with detergent or auxiliary products of any kind, but preferably they are used in automatic dishwashing for dispensing a combination of an organic solvent composition and an automatic dishwashing detergent composition. In preferred embodiments, moreover, at least one of the two or more detergent or auxiliary products, preferably the organic solvent composition, is an anhydrous composition. The term anhydrous as used herein is intended to include compositions containing less than about 10% of water by weight of the composition, preferably less than about 5% of water and more preferably less than about 1%. The water can be present in the form of hydrated compounds, i.e. bound water or in the form of moisture. It is preferred that the composition contains less than about 1%, preferably less than about 0.1% free moisture. Free moisture can be measured by extracting 2 g of the product into 50 ml of dry methanol at room temperature for 20 minutes and then analysis a 1 ml aliquot of the methanol by Karl Fischer titration.

In preferred embodiments the detergent product or auxiliary comprises an organic solvent system. The organic solvent system can simply act as a liquid carrier, but in preferred compositions, the solvent is capable of removing cooked-, baked- or baked-on soils from substrates and thus has detergent functionality in its own right. Organoamine solvents are particularly beneficial in this respect. The organic solvent system (comprising a single solvent compound or a mixture of solvent compounds) preferably has a volatile organic content above 1 mm Hg and more preferably above 0.1 mm Hg of less than about 50%, preferably less than about 20% and more preferably less than about 10% by weight of the solvent system. Herein volatile organic content of the solvent system is defined as the content of organic components in the solvent system having a vapor pressure higher than the prescribed limit at 25° C. and atmospheric pressure.

The organic solvent system for use herein is preferably selected from organoamine solvents, inclusive of alkanolamines, alkylamines, alkyleneamines and mixtures thereof; alcoholic solvents inclusive of aromatic, aliphatic (preferably $C_4$–$C_{10}$) and cycloaliphatic alcohols and mixtures thereof; glycols and glycol derivatives inclusive of $C_2$–$C_3$ (poly)alkylene glycols, glycol ethers, glycol esters and mixtures thereof; and mixtures selected from organoamine solvents, alcoholic solvents, glycols and glycol derivatives. In one preferred embodiment the organic solvent comprises organoamine (especially alkanolamine, more especially 2-aminalkanol) solvent and glycol ether solvent, preferably in a weight ratio of from about 3:1 to about 1:3, and wherein the glycol ether solvent is selected from ethylene glycol monobutyl ether, diethylene glycol monobutyl ether, ethylene glycol monomethyl ether, ethylene glycol monoethyl ether, diethylene glycol monomethyl ether, diethylene glycol monoethyl ether, propylene glycol monobutyl ether, dipropylene glycol, dipropylene glycol methyl ether, and mixtures thereof. Preferably, the glycol ether is a mixture of diethylene glycol monobutyl ether and propylene glycol butyl ether, especially in a weight ratio of from about 1:2 to about 2:1.

Preferred anhydrous dishwashing compositions for use herein take the form of a particulate bleach suspension in a non-aqueous liquid carrier.

Particulate bleaches suitable for use herein include inorganic peroxides inclusive of perborates and percarbonates, organic peracids inclusive of preformed monoperoxy carboxylic acids, such as phthaloyl amido peroxy hexanoic acid and di-acyl peroxides. Preferred peroxides for use herein are percarbonate and perborate bleach.

One problem in formulating particulate bleach into liquid compositions is to keep the bleach physically stable and homogeneously distributed in the liquid composition. Bleach suspension can be achieved by matching the density of the liquid carrier and the particulate bleach. To this end, the density difference between the particulate bleach and the non-aqueous liquid carrier is preferably less than about 500 $Kg/m^3$, more preferably less than about 300 $Kg/m^3$. High viscosity and small particle size will also contribute to the formation of a stable suspension. In one embodiment of the present invention, the particulate bleach has an average particle size from about 10 $\mu$m to about 500 $\mu$m, preferably from about 30 $\mu$m to about 250 $\mu$m, as measured using a Malvern particle size analyser based on laser diffraction. The suitable viscosities for the suspensions used herein are from about 1,000 $Kg/m\ s^{-1}$ to about 100,000 $Kg/m\ s^{-1}$, preferably from about 5,000 $Kg/m\ s^{-1}$ to about 50,000 $Kg/m\ s^{-1}$ at shear rate of $1s^{-1}$; and from about 500 $Kg/m\ s^{-1}$ to about 50,000 $Kg/m\ s^{-1}$, preferably from about 800 $Kg/m\ s^{-1}$ to about 30,000 $Kg/m\ s^{-1}$ at shear rate of $150s^{-1}$ as measured using a Contraves Rheometer with 40 mm diameter parallel plate at 25° C.

The stability of the bleach suspension can also be enhanced through the use of suspending agents. Herein, it has now been found bleaches such as perborates and percarbonates are incompatible with some of the traditional thickeners used as suspending agents for example the polymeric thickeners and clays. It has further been found that cellulosic type thickeners have improved bleach compatibility and give rise to physically stable suspensions. Suitable thickener materials for use herein include hydroxyethyl and hydroxymethyl cellulose (ETHOCEL and METHOCEL® available from Dow Chemical), hydroxpropyl cellulose (Klucel H and Klucel M) and mixtures thereof.

In order to improve bleach and formulation stability a free radical scavenger can be added to the suspension. Suitable free radical scavengers for use herein include benzoic acids, sulfobenzenes and mixtures thereof.

In preferred embodiments at least one of the detergent products or auxiliaries includes a detersive enzyme and/or an alkalinity source.

In preferred embodiments the one or more detergent or auxiliary products additionally comprise a spreading auxiliary. The function of the spreading auxiliary is to reduce the interfacial tension between solvent and soil, therefore increasing the wettability of the soils. The spreading auxiliary when added to the compositions herein leads to a lowering in the surface tension of the compositions, preferred spreading auxiliaries being those which lower the surface tension below that of the auxiliary itself. Especially useful are spreading auxiliaries able to render a surface tension below about 30 mN/m, preferably below about 28 mN/m and more preferably below about 26 mN/m, and especially below about 24 mN/m. Surface tensions are measured herein at 25° C. Spreading auxiliaries for use herein can be selected from organic solvents, wetting agents and mixtures thereof. Preferred wetting agents for use herein are silicone polyether copolymers, especially silicone poly (alkyleneoxide) copolymers wherein alkylene is selected from ethylene, propylene and mixtures thereof.

The washing process herein is preferably undertaken at low wash liquor surface tension, this being valuable, in conjunction with the defined dishwashing compositions from the viewpoint of providing optimum cleaning performance, especially from cooked-, baked- and burnt-on soils. Preferably, the surface tension of the wash liquor after delivery of the two or more detergent or auxiliary products is less than about 35 mN/m, preferably less than about 32 mN/m more preferably less than about 30 mN/m and especially less than about 28 mN/m.

According to another aspect of the invention there is provided a washing machine incorporating a built-in or replaceable detergent pack as described herein, the washing machine being programmable in accordance with the requirements of the user or of the wash process parameters to automatically deliver quantities of the two or more products from the storage means into the same or different cycles of the washing machine.

DETAILED DESCRIPTION OF THE INVENTION

The present invention envisages the use of a detergent pack for use in conjunction with a washing machine. The pack comprises separate but associated means for storage of two or more detergent or auxiliary products and means for dispensing predetermined quantities at controlled relative dispensing rate of the two or more detergent or auxiliary products. The invention also envisages detergent packs comprising detergent products or auxiliaries in the form of anhydrous liquids, especially useful compositions being those containing an organic solvent capable of remove baked-, cook- or burnt-on soils; and those comprising anhydrous suspensions containing particulate bleach.

BRIEF DESCRIPTION OF THE DRAWING

While the specification concludes with claims particularly pointing out and distinctly claiming the present invention, it is believed the same will be better understood from the following description taken in conjunction with the accompanying drawings in which:

Figure 1:
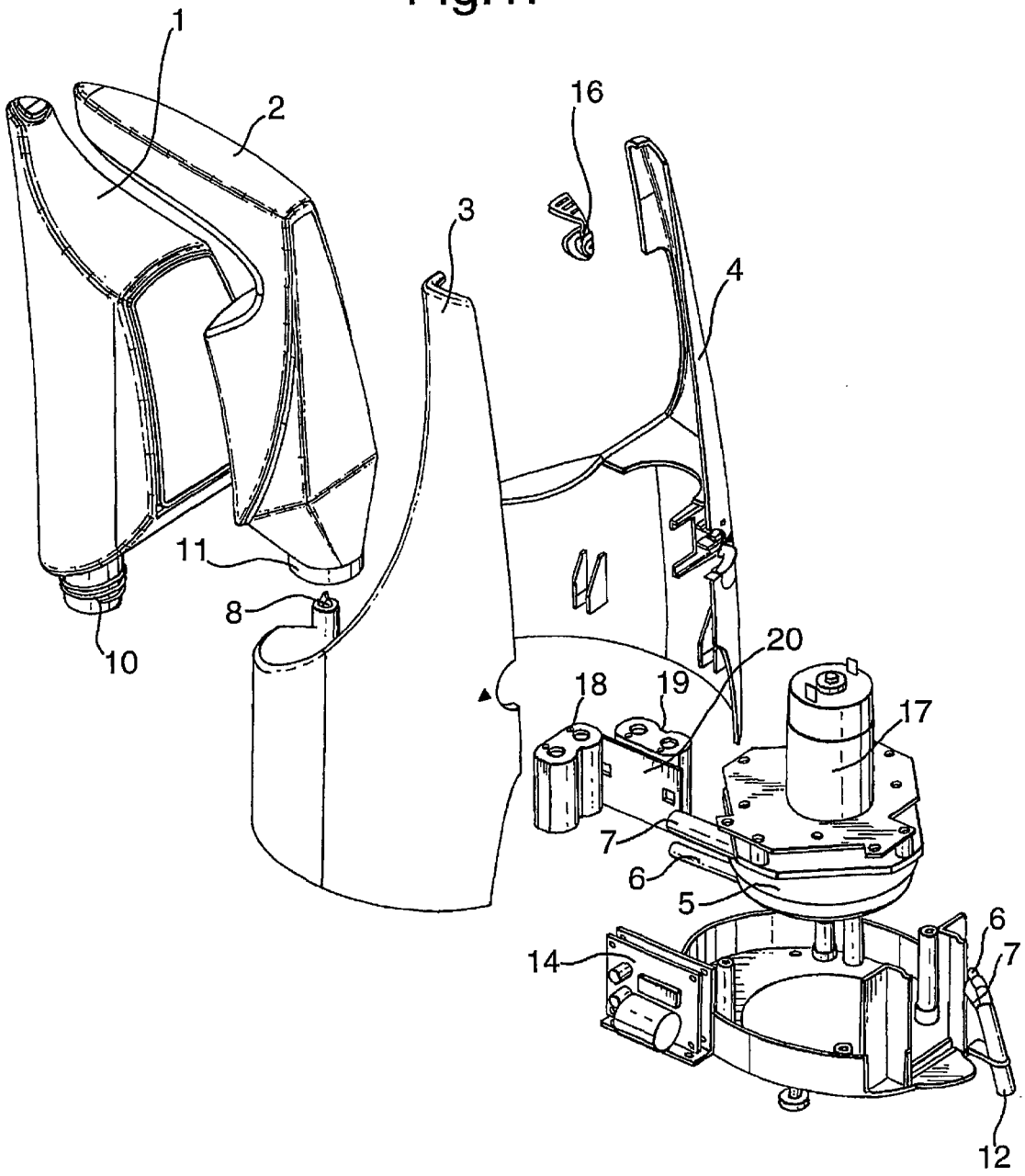
FIG. 1 is an exploded perspective view of a detergent pack according to the invention.

The detergent pack of FIG. 1 comprises in general terms:

a) two detergent or auxiliary products in fluid form;

b) corresponding containers 1 and 2 for bulk storage of the products;

c) conduit means 6 and 7 connected with the product containers and communicating with two dispensing orifices and a common associated valve means 12; and d) pump means 5 for providing controlled dispensing of the fluids.

The containers for bulk storage of fluid are bottles 1 and 2 of any convenient material and any convenient shape suitable for fitting within shell portions 3 and 4 of the detergent pack. In the exemplified embodiment, the bottles are placed in the shell up-side down, with both outlets lowermost, in order to take advantages of gravitational forces and to avoid the need for tilting. The pack also includes a pair of duckbill valve means 8 and 9 one for each container which can be used to breach the container seals after insertion of the bottles within the shell and to provide means for venting the product containers. The pack is thus designed to allow easy replacement of the bottles in an upside down orientation.

The fluids are dispensed in controlled proportions by means of a pump 5. In the exemplified embodiment the pump is a peristaltic positive displacement pump. The fluids are dispensed from bottles 1 and 2 through flexible tubes 6 and 7 (shown only in part) by means of the peristaltic pump 5. The exemplified pump arrangement used herein comprises two flexible tubes 6 and 7 and a pump 5 having a single pump head. Each container has a duckbill valve 8 and 9 in the vicinity of the inlets to the flexible tubes. The duckbill valves 8 and 9 allow free flow of fluid with positive differential pressure. Each flexible tube 6 and 7 is connected at its upper end to the outlet 10 or 11 of one of the bottles, passes via the pump 5 and terminates at the common slit seal valve 12 situated within a moveable spout 13. The pump 5 is designed to dispense a fixed ratio of the different fluids. Each tube passing through the pump 5 is fitted to a curved track mounted concentrically with a rotor carrying three rollers. As the rollers rotate, they flatten the tube against the track at the points of contract. This "flats" move the fluid by positive displacement. For clarity, only the pump inlet and valve inlet portions of tubes 6 and 7 are illustrated in FIG. 1.

Figure 2:
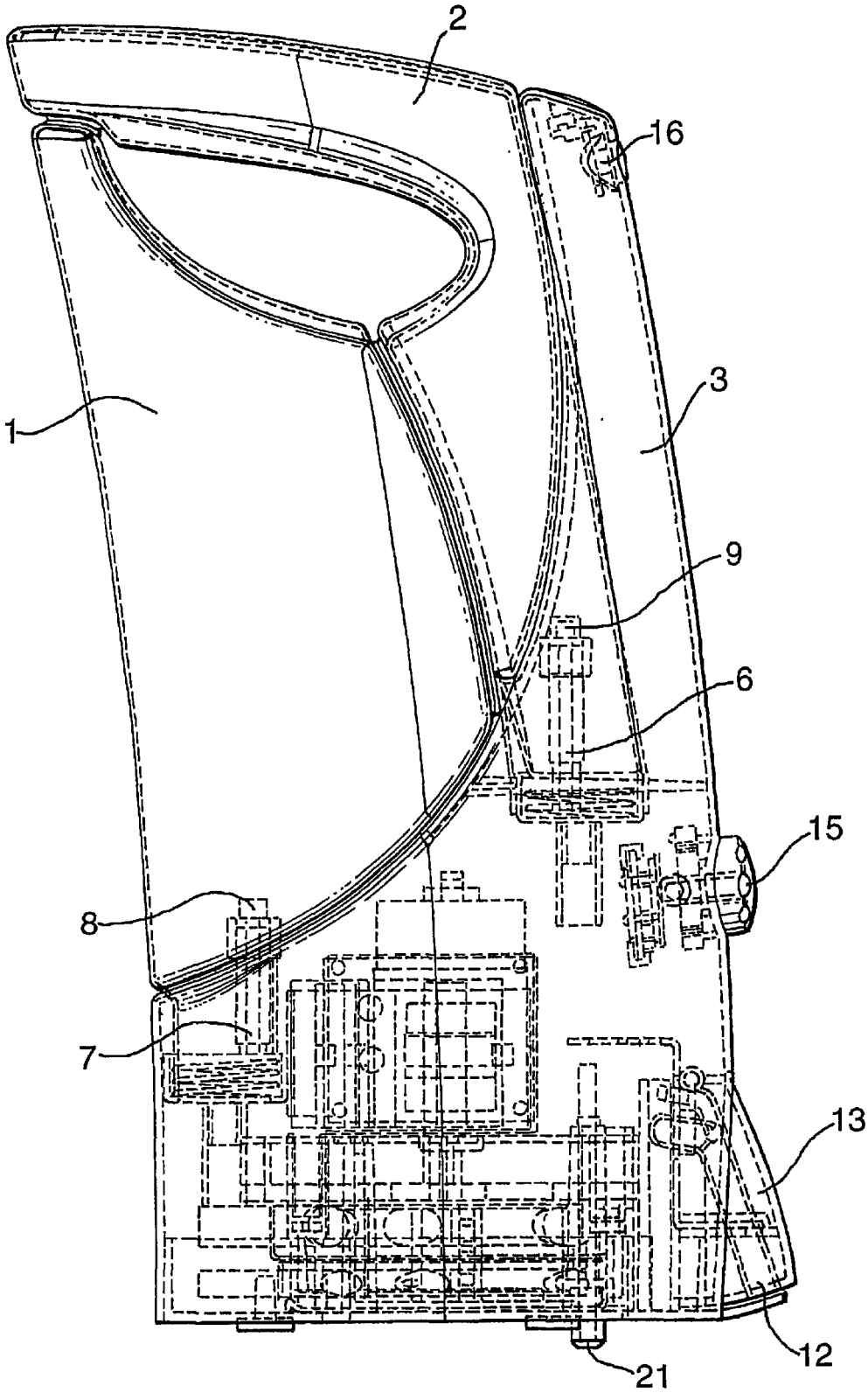
FIG. 2 is a partial fragmentary side view of the detergent pack of FIG. 1.

The pump is electrically activated and controlled by a microprocessor 14. The user can choose among different fixed doses via a dose selector button 15 as illustrated in FIG. 2. Furthermore, the pack includes a button 16 which allows the user to deliver a variable amount of fluid. The pump is driven by a motor 17 powered by disposable batteries 18 and 19 which are placed in a mounting plate 20 in the bottom unit. The flow is controlled by the number of turns of the motor 17. As illustrated in FIG. 2 the pack comprises an automatic electrical supply cut off button 21, which is activated when the apparatus rests on a surface (in order to avoid accidental dosing of the fluids).

The pack is also provided with a retro-pumping system (not illustrated) which acts at the end of each dose in order to prevent dripping.

The detergent pack is used for storage and dispensing of two or more detergent products or auxiliaries. The detergent products or auxiliaries generally comprise one or more organic solvents and can additionally comprises surfactant, bleach, enzyme, enzyme stabilising components, thickener, etc.

The following are examples of detergent products and auxiliaries which can be used in the packs of the invention.

ABBREVIATIONS USED IN EXAMPLES

In the examples, the abbreviated component identifications have the following meanings:

| | |
|---|---|
| Carbonate | Anhydrous sodium carbonate |
| STPP | Sodium tripolyphosphate |
| SKTP | Sodium potassium tripolyphosphate |
| Silicate 3.2 | Amorphous Sodium Silicate ($SiO_2$:$Na_2O$ ratio = 3.2:1) |
| KOH | Potassium hydroxide |
| PB1-50 | Sodium perborate monohydrate average particle size 50 $\mu$m |
| PAP | N,N-Pthaloylaminoperoxycaproic acid |
| Termamyl | α-amylase available from Novo Nordisk A/S |
| FN3 | protease available from Genencor |
| SLF18 | low foaming surfactant available from BASF |
| ACNI | alkyl capped non-ionic surfactant of formula $C_{9/11}H_{19/23}EO_8$-cyclohexyl acetal |
| $C_{14}AO$ | tetradecyl dimethyl amine oxide |
| $C_{16}AO$ | hexadecyl dimethyl amine oxide |
| Proxel GXL | preservative(1,2-benzisothiazolin-3-one) available from Zeneca, Inc |
| Polygel premix | 5% active Polygel DKP in water available from 3V Inc. |
| CaCl2 | Calcium chlorine |
| MEA | Monoethanolamine |
| MAE | 2-(methylamino)ethanol |
| 2-A-2-MP | 2-amino-2-methyl-1-propanol |
| SF1488 | Polydimethylsiloxane copolymer |
| DPM | Dipropylene glycol methyl ether |
| Silwet L7600 | Siloxane surfactant available from Witco |

In the following examples all levels are quoted as parts by weight.

Examples 1 to 8

Examples 1 to 8 illustrate the use of a combination of an automatic dishwashing liquid detergent and an organic solvent composition for removing cooked-, baked- and burnt-on soils. The two-component compositions are stored in a dual-compartment storage container having an electrically operated pump as described herein with reference to FIG. 1 and delivered at a feed ratio (dishwashing liquid detergent: organic solvent composition) of 1:1. The compositions of examples 1 to 8 are used to wash the following dishware load according to the procedure described herein below. The load comprises different soils and different substrates: lasagne baked for 2 hours at 140° C. on Pyrex, lasagne cooked for 2 hours at 150° C. on stainless steel, potato and cheese cooked for 2 hours at 150° C. on stainless steel, egg yolk cooked for 2 hours at 150° C. on stainless steel and sausage cooked for 1 hour at 120° C. followed by 1 hour at 180° C. The load is washed in a 5 liter liquor capacity Bosch 6032 dishwashing machine, at 55° C. without prewash, using 40 ml of the compositions given in Examples 1 to 8. The two-component compositions of examples 1 to 8 provide excellent removal of cooked-on, baked-on and burnt-on food soils. The above examples 1 to 8 were repeated in a modified detergent pack using a dishwashing liquid detergent: organic solvent composition feed ratio of 4:1 with similar results.

| Example | 1 | 2 | 3 | 4 |
|---|---|---|---|---|
| Dishwashing detergent composition | | | | |
| STPP | 28.00 | 28.00 | 28.00 | 28.00 |
| KOH | 5.30 | 5.30 | 5.30 | 5.30 |
| Silicate 3.2 | 1.0 | 1.0 | 1.0 | 1.0 |
| Polygel DKP | 0.55 | 0.55 | 0.55 | 0.55 |
| SLF18 | 1.25 | | 1.25 | |
| $C_{16}AO$ | | 0.40 | | 0.40 |

-continued

| Example | 1 | 2 | 3 | 4 |
|---|---|---|---|---|
| ACNI | | 3.00 | | 3.00 |
| Water | | | to 100 | |
| Organic solvent composition | | | | |
| MEA | 74.00 | | 37.00 | 37.00 |
| MAE | | 74.00 | 37.00 | 37.00 |
| PB1-50 | 18.5 | 18.5 | 18.5 | 18.5 |
| FN3 | 2.60 | 2.60 | 2.60 | 2.60 |
| Termamyl | 3.34 | 3.34 | 3.34 | 3.34 |
| Thickener | 1.56 | 1.56 | 1.56 | 1.56 |

| Example | 5 | 6 | 7 | 8 |
|---|---|---|---|---|
| Dishwashing detergent composition | | | | |
| SKTP | 28.00 | 28.00 | 28.00 | 28.00 |
| KOH | 2.10 | 2.10 | 2.10 | 2.10 |
| Polygel DKP | 0.55 | 0.55 | 0.55 | 0.55 |
| SLF18 | 1.25 | 1.00 | | |
| $C_{16}AO$ | 2.00 | | 2.5 | |
| $C_{14}AO$ | | 3.00 | | 3.00 |
| ACNI | | | 2.00 | 2.00 |
| Liquid FN3 | 0.9 | 0.9 | 0.9 | 0.9 |
| Termamyl | 0.6 | 0.6 | 0.6 | 0.6 |
| 1,2 Propanediol | 0.5 | 6.0 | 6.0 | 6.0 |
| Boric acid | 3.0 | 4.0 | 4.0 | 4.0 |
| $CaCl_2$ | 0.22 | 0.22 | 0.22 | 0.22 |
| Sodium benzoate | 0.2 | 0.2 | 0.2 | 0.2 |
| Proxel GXL | 0.01 | 0.01 | 0.01 | 0.01 |
| Perfume | 0.1 | 0.1 | 0.1 | 0.1 |
| Water | | | to 100 | |
| Anhydrous composition | | | | |
| 2A-2-MP | 45.00 | 50.00 | | |
| DPM | | | 45.00 | 50.00 |
| PB1-50 | 8.5 | 8.5 | 8.5 | 8.5 |
| Methocel | 0.5 | 0.6 | 0.5 | 0.6 |
| FN3 | | 3.34 | | 3.34 |
| Termamyl | | 1.56 | | 1.56 |
| STPP | 16.00 | 16.00 | 16.00 | 16.00 |
| Carbonate | 30.00 | 20.00 | 30.00 | 20.00 |

What is claimed is:

1. A detergent pack for use in conjunction with a washing machine, comprising:

two or more detergent or auxiliary products;

storage means comprising separate but associated portions of the two or more products; and means for delivering quantities of the two or more products into the same or different cycles of a washing machine;

wherein the means for delivering comprises means for dispensing quantities of the two or more products, and means for controlling the relative dispensing rate of the two or more products from the storage means;

wherein the means for dispensing comprises one or more conduit means communicating with one or more dispensing orifices and having one or more valve means associated therewith to enable or cut off the flow of product through the one or more dispensing orifices, and one or more valves situated at or proximal the inlet of the conduit means to enable venting of the product container.

2. A pack according to claim 1 wherein the storage means comprises at least two product containers for separate storage of the two or more detergent or auxiliary products.

3. A pack according to claim 1 comprising means for refilling the storage means or wherein the storage means can be removed and replaced as a unit for the purpose of recharging the pack with fresh product.

4. A pack according to claim 1 incorporating an outer shell and wherein the storage means is adapted to fit wholly or partially within the outer shell whereby the outer shell forms at least part of the external framework of the pack.

5. A pack according to claim 1 wherein the storage means comprises two or more product containers mounted in an inverted orientation with corresponding outlets directed in a generally downward direction to provide gravitational-assisted dispensing therefrom.

6. A pack according to claim 5 wherein the volumes of the two or more product containers are in integer ratio to one another.

7. A pack according to claim 1, wherein the conduit means comprises flexible tubes having the same or different diameter and leading from the storage means to the outlet with a common valve means or to each dispensing orifice.

8. A pack according to claim 7 comprising separate conduit means for each of the two or more products, the separate conduit means communicating with a common valve means.

9. A pack according to claim 1, wherein the valve means comprises a slit seal valve.

10. A pack according to claim 1 wherein the means for controlling the relative dispensing rate comprises one or more electrically operated pumps adapted to dispense the two or more products at given flow rates, or for given dispensing times or in a given product dispensing sequence.

11. A pack according to claim 10 comprising means for pumping the two or more products in a reverse direction at the end of the dispensing cycle in order to prevent excess product dripping from the dispensing orifices.

12. A pack according to claim 1 wherein the means for controlling the relative dispensing rate comprises a positive displacement pump.

13. A pack according to claim 12 wherein the positive displacement pump is a peristaltic pump.

14. A pack according to claim 1 comprising a plurality of flexible tubes acting as conduit means for the two or more products and comprising a peristaltic pump operatively associated with the plurality of flexible tubes to control the relative dispensing rate of the two or more products.

15. A pack according to claim 14 wherein the relative dispensing rate is controlled by adjusting the relative diameter of the flexible tubes and the rheology of the detergent or auxiliary products.

16. A pack according to claim 1 wherein the detergent or auxiliary products are delivered in a generally downward direction from one or more dispensing orifices situated at or near the bottom of the pack.

17. A pack according to claim 1 wherein the pack is a hand-held self-contained pack.

18. A pack according to claim 1 comprising an automatic cut-off switch operable when the pack is resting on a surface.

19. A pack according to claim 1 additionally incorporating means for preselecting the quantities of the two or more products to be dispensed from the storage means and means overriding the preselecting means to provide continuous dispensing of the two or more products.

20. A pack according to claim 1 additionally incorporating means to provide a visual indication of dispensing, said means being in the form of a moveable spout activated during dispensing and situated in the vicinity of the one or more dispensing orifices.

21. A pack according to claim 1 for use in automatic dishwashing and wherein the pack comprises an organic solvent composition and an automatic dishwashing detergent composition.

22. A pack according to claim 21 wherein the organic solvent composition comprises an organic solvent system acting as carrier solvent or as agent for removing cooked-, baked- and burnt-on soils.

23. A pack according to claim 22 wherein the organic solvent system is selected from alcohols, amines, esters, glycol ethers, glycols, terpenes and mixtures thereof.

24. A pack according to claim 22 wherein the organic solvent system is selected from organoamine solvents, alcoholic solvents, glycols and glycol derivatives and mixtures thereof.

25. A pack according to claim 22 wherein the organic solvent comprises organoamine solvent and glycol ether solvent and wherein the glycol ether solvent is selected from ethylene glycol monobutyl ether, diethylene glycol monobutyl ether, ethylene glycol monomethyl ether, ethylene glycol monoethyl ether, diethylene glycol monomethyl ether, diethylene glycol monoethyl ether, propylene glycol monobutyl ether, dipropylene glycol, dipropylene glycol methyl ether, dipropylene glycol monobutyl ether, ethylene glycol phenyl ether and mixtures thereof.

26. A pack according to claim 21 wherein at least one product comprises a detergency enzyme.

27. A pack according to claim 21 wherein at least one product comprises an alkalinity source.

28. A pack according to claim 21 wherein at least one of the products comprises a spreading auxiliary selected from organic solvents, wetting agents and mixtures thereof such that the liquid surface tension of the spreading auxiliary is less than about 30 mN/m.

29. A pack according to claim 1 wherein the two or more detergent or auxiliary products are in gel form, the rheology of the gel-form compositions being matched to provide dispensing of the two or more products at a controlled relative dispensing rate.

30. A pack according to claim 1 wherein at least one product is an anhydrous composition.

31. A pack according to claim 30, wherein the anhydrous composition comprises a particulate bleach suspension in a non-aqueous liquid carrier.

32. A pack according to claim 31 wherein the particulate bleach is selected from inorganic peroxides, organic peracids and mixtures thereof.

33. A pack according to claim 31 wherein the particulate bleach has a particle size from about 10 $\mu$m to about 500 $\mu$m.

34. A pack according to claim 31 wherein the particulate bleach is perborate.

35. A pack according to claim 31 wherein the anhydrous composition comprises a free radical scavenger selected from benzoic acids, sulfobenzenes and mixtures thereof.

36. A pack according to claim 31 wherein the anhydrous composition comprises a cellulosic thickener material.

37. A pack according to claim 31, wherein the density difference between the particulate bleach suspension and the non-aqueous liquid carrier is less than about 500 Kg/m$^3$.

38. A pack according to claim 31 wherein the suspension has a viscosity of from about 1,000 Kg/m s$^{-1}$ to about 100,000 Kg/m s$^{-1}$ at shear rate of 1s$^{-1}$; and from about 500 Kg/m s$^{-1}$ to about 50,000 Kg/m s$^{-1}$ at shear rate of 150s$^{-1}$ as measured using a Contraves Rheometer with 40 mm diameter parallel plate at 25° C.

39. A washing machine incorporating a built-in or replaceable detergent pack according to claim 1 and being programmable in accordance with the requirements of the user or of the wash process parameters to automatically deliver quantities of the two or more products from the storage means into the same or different cycles of the washing machine.

40. A method of delivering two or more detergent or auxiliary products into a washing machine comprising the use of a detergent pack according to claim 1.

* * * * *